US006363629B1

(12) United States Patent
Curtis

(10) Patent No.: US 6,363,629 B1
(45) Date of Patent: Apr. 2, 2002

(54) VEHICLE HITCH MOUNT ASSEMBLY FOR A SNOW PLOW

(75) Inventor: Marc D. Curtis, Spencer, MA (US)

(73) Assignee: Curtis International, Inc., Worcester, MA (US)

( * ) Notice: Subject to any disclaimer, the term of this patent is extended or adjusted under 35 U.S.C. 154(b) by 0 days.

(21) Appl. No.: 09/507,291

(22) Filed: Feb. 18, 2000

(51) Int. Cl.[7] ..... E01H 5/04

(52) U.S. Cl. ..... 37/231; 172/677; 280/508; 280/511

(58) Field of Search ..... 37/231, 232, 235, 37/236, 241, 264, 266, 263; 172/677, 678, 679, 680, 681, 684.5; 280/477, 511, 512, 513, 508, 509

(56) References Cited

U.S. PATENT DOCUMENTS

| | | | | |
|---|---|---|---|---|
| 1,890,730 | A | 12/1932 | Hunt | |
| 1,918,771 | A | 7/1933 | Meyer | |
| 2,046,918 | A | 7/1936 | Kruse | 254/124 |
| 2,057,326 | A | 10/1936 | Coates | 37/42 |
| 2,119,263 | A | 5/1938 | Baumgardner | 280/33.1 |
| 2,141,558 | A | 12/1938 | Richter | 37/42 |
| 2,322,358 | A | 6/1943 | Hansen | 254/86 |
| 2,383,666 | A | 8/1945 | Martin | 280/33.44 |
| 2,426,410 | A | 8/1947 | Owen | 37/42 |
| 2,555,925 | A | 6/1951 | Genthe | 254/86 |
| 2,577,145 | A | 12/1951 | Nearing et al. | 280/33.15 |
| 2,642,294 | A | 6/1953 | Holm | 280/33.13 |
| 2,662,459 | A | 12/1953 | Shore | 97/47.15 |
| 2,667,708 | A | 2/1954 | Gjesdahl | 37/42 |
| 2,697,289 | A | 12/1954 | Standfuss | 37/42 |
| 2,703,244 | A | 3/1955 | Nearing | 280/504 |
| 2,710,464 | A | 6/1955 | Husting | 37/42 |
| 2,840,391 | A | 6/1958 | Stiel | 280/150.5 |
| 3,098,309 | A | 7/1963 | Koch | 37/42 |
| 3,150,884 | A | 9/1964 | Drott | 280/460 |
| 3,214,138 | A | 10/1965 | Jocher et al. | 254/124 |
| 3,250,026 | A | 5/1966 | Jocher et al. | 37/42 |
| 3,285,625 | A | 11/1966 | Krueger | 280/479 |
| 3,332,562 | A | 7/1967 | Kokott | 214/86 |
| 3,343,850 | A | 9/1967 | Stauss et al. | 280/504 |
| 3,388,929 | A | 6/1968 | Miley | 280/481 |
| 3,410,008 | A | 11/1968 | Standfuss | 37/42 |
| 3,412,489 | A | 11/1968 | Klapprodt et al. | 37/42 |
| 3,427,046 | A | 2/1969 | Sommer et al. | 280/479 |
| 3,434,737 | A | 3/1969 | Bailey et al. | 20/461 |
| 3,483,641 | A | 12/1969 | Hirt | 37/44 |
| 3,512,804 | A | 5/1970 | Siegert | 280/509 |

(List continued on next page.)

FOREIGN PATENT DOCUMENTS

| | | |
|---|---|---|
| CA | 916646 | 12/1972 |
| CA | 1182638 | 2/1985 |
| CA | 1220022 | 4/1987 |
| CA | 1253003 | 4/1989 |
| CA | 2023065 | 10/1991 |
| CA | 2027411 | 4/1992 |
| CA | 1300877 | 5/1992 |
| CA | 1303362 | 6/1992 |
| CA | 1318786 | 6/1993 |
| CA | 2121948 | 10/1994 |
| CA | 2123340 | 9/1995 |
| CA | 2090992 | 5/1996 |
| CA | 2137853 | 1/1999 |
| DE | 1164323 | 2/1964 |
| DE | 1255376 | 11/1967 |
| FR | 1272636 | 1/1962 |
| FR | 1489716 | 7/1967 |

*Primary Examiner*—Victor Batson
(74) *Attorney, Agent, or Firm*—Nields & Lemack

(57) ABSTRACT

Hitch mount for hydraulically driven snow blades or other accessories that includes a mounting frame for mounting to the vehicle chassis and a one piece plow assembly and lift frame readily removably coupled to the mounting frame, the plow assembly preferably including a blade trip frame and a snow blade removably coupled to the trip frame. A optional power operated jack can be used to raise or lower the lift frame relative to the vehicle chassis.

20 Claims, 7 Drawing Sheets

U.S. PATENT DOCUMENTS 3,524,269 A 8/1970 Jackoboice ..... 37/42
3,528,685 A 9/1970 Eastman ..... 280/479
3,531,140 A 9/1970 Di Vi ta et al. ..... 280/477
3,659,362 A 5/1972 Bell ..... 37/42 R
3,746,368 A 7/1973 Gledhill et al. ..... 280/481
3,760,883 A 9/1973 Birk ..... 172/273
3,769,724 A 11/1973 Norgaard ..... 37/41
3,793,752 A 2/1974 Snyder ..... 37/42 R
3,801,068 A 4/1974 Kopas ..... 254/86 R
3,815,687 A 6/1974 Federspiel ..... 172/801
3,851,894 A 12/1974 St. Pierre ..... 280/460 R
3,860,216 A 1/1975 Brown ..... 254/86 H
3,876,092 A 4/1975 MacDonald ..... 214/145
3,987,562 A 10/1976 Deen et al. ..... 37/42 R
4,074,448 A 2/1978 Niemela ..... 37/41
4,090,725 A 5/1978 Périn ..... 280/479
4,127,951 A 12/1978 Hutch ..... 37/44
4,176,727 A 12/1979 Perin ..... 180/53 R
4,187,624 A 2/1980 Blau ..... 37/42 R
4,205,825 A 6/1980 Stanford ..... 254/86 R
4,236,329 A 12/1980 Hetrick ..... 37/42 R
4,244,122 A 1/1981 Hetrick ..... 37/41
4,253,793 A 3/1981 Braml ..... 414/723
4,255,884 A 3/1981 Williams ..... 37/117.5
4,259,794 A 4/1981 Rath ..... 37/42 VL
4,265,587 A 5/1981 Clark ..... 414/723
4,268,058 A 5/1981 Farrell et al. ..... 280/481
4,342,163 A 8/1982 Hoekstra ..... 37/231
4,357,995 A 11/1982 Kappenhagen ..... 187/17
4,391,052 A 7/1983 Guy, Jr. ..... 37/236
4,403,432 A 9/1983 Biance ..... 37/235
4,436,477 A 3/1984 Lenertz et al. ..... 414/723
4,439,939 A 4/1984 Blau ..... 37/231
4,452,560 A 6/1984 Coyle et al. ..... 414/723
4,462,172 A 7/1984 Caron ..... 37/231
4,470,211 A 9/1984 Rossmann ..... 37/231
4,574,502 A 3/1986 Blau ..... 37/266
4,619,060 A 10/1986 Knowlton ..... 37/231
4,658,519 A 4/1987 Quenzi ..... 37/23
4,662,610 A 5/1987 Cofer ..... 254/420
4,711,428 A 12/1987 Carpenter ..... 254/423
4,717,166 A 1/1988 Vachon ..... 280/481
4,744,159 A 5/1988 Houle ..... 37/231
4,747,612 A 5/1988 Kuhn ..... 280/460 A
4,807,375 A 2/1989 Iraci ..... 37/236
4,817,728 A 4/1989 Schmid et al. ..... 172/273
4,821,435 A 4/1989 Pester ..... 37/231
4,833,799 A 5/1989 Harte et al. ..... 37/231
4,962,598 A 10/1990 Woolhiser et al. ..... 37/231
4,962,599 A 10/1990 Harris ..... 37/266
4,976,053 A 12/1990 Caley ..... 37/231
4,991,323 A 2/1991 Benkler ..... 37/235
4,999,935 A 3/1991 Simi et al. ..... 37/236
5,014,452 A 5/1991 Berghefer ..... 37/235
5,027,536 A 7/1991 Farrell ..... 37/236
5,031,927 A 7/1991 Frenette ..... 280/481
5,036,608 A 8/1991 Ciula ..... 37/236
5,050,322 A 9/1991 Burkard ..... 37/270
5,082,065 A 1/1992 Fletcher ..... 172/273
5,087,063 A 2/1992 Merrill, Jr. ..... 280/475
5,088,215 A 2/1992 Ciula ..... 37/197
5,111,603 A 5/1992 Knowlton et al. ..... 37/231
5,125,174 A 6/1992 Watson et al. ..... 37/231
5,136,795 A 8/1992 Rosenberg ..... 37/233
5,145,313 A 9/1992 Weyer ..... 414/723
5,155,929 A 10/1992 Vachon ..... 37/266
5,195,261 A 3/1993 Vachon ..... 37/231
5,244,047 A 9/1993 Eudy ..... 172/275
5,353,530 A 10/1994 Pieper ..... 37/231
5,361,519 A 11/1994 Ciula et al. ..... 37/234
5,368,409 A 11/1994 Marzullo et al. ..... 403/324
5,397,187 A 3/1995 Cachinero et al. ..... 384/460
5,415,235 A 5/1995 Gebauer ..... 172/273
5,456,030 A 10/1995 Barone et al. ..... 37/468
5,479,730 A 1/1996 Gogan ..... 37/231
5,485,690 A 1/1996 MacQueen ..... 37/271
5,524,368 A 6/1996 Struck et al. ..... 37/235
5,540,289 A 7/1996 Hirooka et al. ..... 172/274
5,566,694 A 10/1996 Capra et al. ..... 37/231
5,595,607 A 1/1997 Biance ..... 37/268
5,743,339 A 4/1998 Alexander, III ..... 172/272
5,778,567 A 7/1998 Jager et al. ..... 37/235
5,806,214 A 9/1998 Behrens et al. ..... 37/231
5,815,956 A 10/1998 Lavin et al. ..... 37/241
5,832,637 A 11/1998 Aguado et al. ..... 37/234
5,894,688 A 4/1999 Struck et al. ..... 37/271
5,915,837 A 6/1999 Brown et al. ..... 37/468
5,924,223 A 7/1999 Hone, Jr. ..... 37/231
6,070,343 A * 6/2000 Sheldon ..... 37/267
6,102,131 A 8/2000 Malinowski ..... 172/273
6,142,500 A * 11/2000 Sargent ..... 280/405.1
6,145,222 A * 11/2000 Curtis ..... 37/231
6,151,808 A * 11/2000 Curtis ..... 37/234
6,202,328 B1 * 3/2001 Fulton ..... 37/231
6,209,231 B1 * 4/2001 Curtis ..... 37/231

* cited by examiner

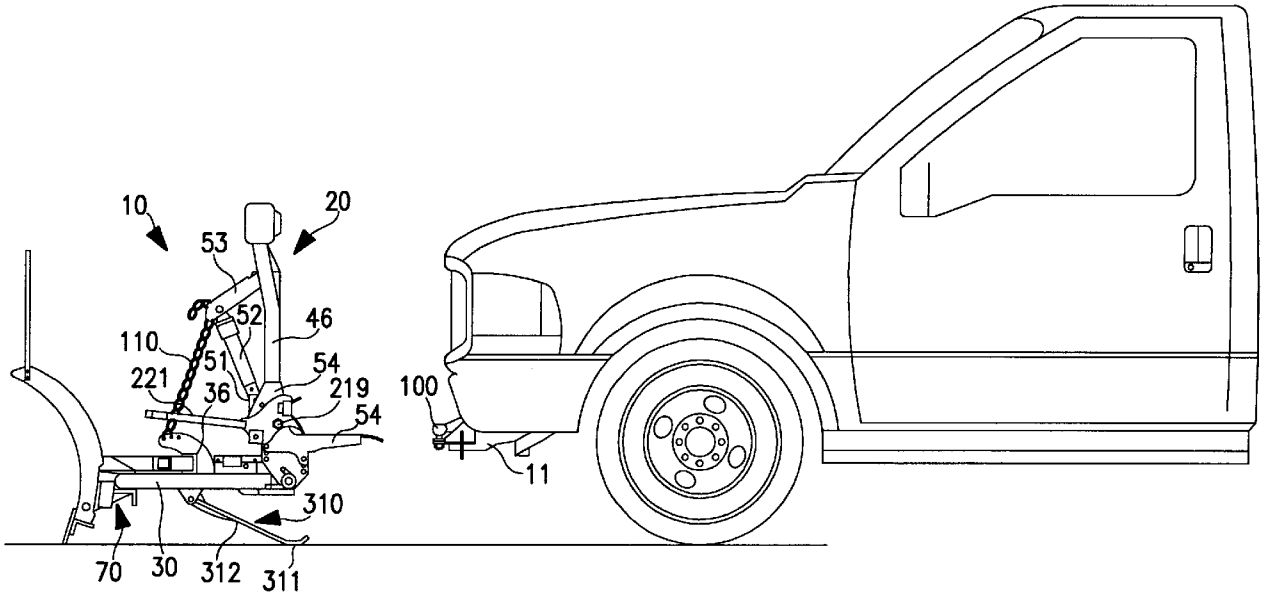
FIG. IA
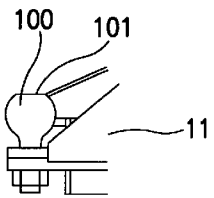
FIG. IB
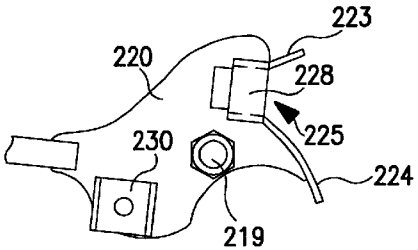
FIG. IC

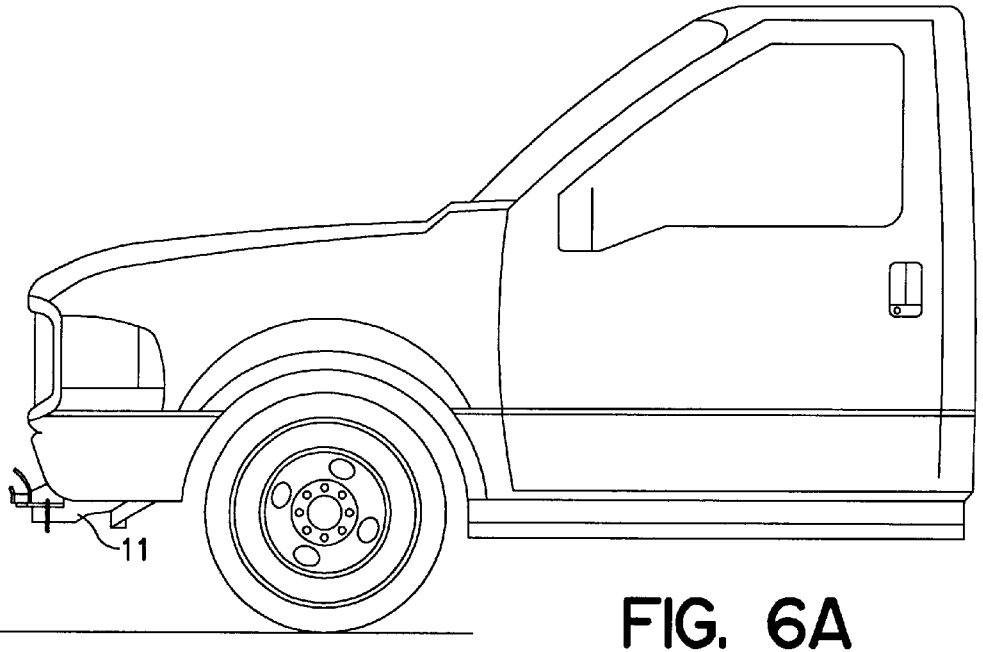
FIG. 6A
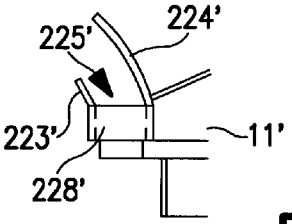
FIG. 6C
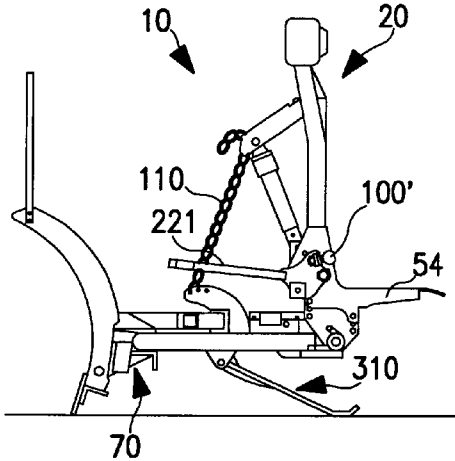
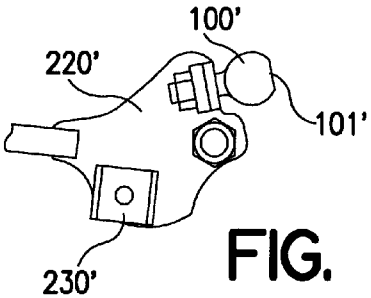
FIG. 6B

VEHICLE HITCH MOUNT ASSEMBLY FOR A SNOW PLOW

BACKGROUND OF THE INVENTION

Conventional snow blade mounts for four wheel drive vehicles such as pick-up trucks can weigh several hundred pounds, and generally include a chassis frame that can be permanently fixed to the vehicle chassis, usually behind the vehicle front bumper. A lift frame is then removably coupled to the chassis frame, and the snow blade is then coupled to the front end of the assembly via an A-frame and trip frame assembly. The A-frame with the snow blade attached is typically removable from the vehicle. Conventionally, the lift frame has been permanently mounted to the chassis frame (and therefore not readily removable from the vehicle), and the hydraulic pump used to operate the snow blade was located under the vehicle hood, and were driven using a belt drive driven by the vehicle engine. However, safety considerations now often dictate that the lift frame be removed when the plow is not in use. In addition, crash zones and barrier testing are altered by locating the electric/hydraulic pump under the vehicle hood in juxtaposition with the vehicle engine. Moreover, such a location is also no longer feasible since there is little room there to accommodate the pump, and since most vehicles today use a single serpentine belt, again eliminating the feasibility of driving the hydraulics with a belt driven by the vehicle engine. Accordingly, most snow blade mounts today locate the blade actuator drive assembly in front of the vehicle grill, slightly higher than the vehicle front bumper. This arrangement hinders air flow to the vehicle engine, often resulting in engine overheats.

One drawback of conventional snow blade mounts is the difficulty in readily removing the lift frame assemblies from the vehicle chassis, especially in view of their weight. To that end, U.S. Pat. No. 5,125,174 discloses a removable snowplow including a removable lift frame and A-frame combination. However, the lift frame assembly is permanently mounted to the A-frame, thus requiring removal of both simultaneously, as a unit. U.S. Pat. No. 5,353,530 is of a similar vein.

Conventional mounting systems utilize a pin arrangement, whereby the vehicle and mount assembly must be properly aligned prior to coupling the mount to the chassis with a pair of pins. This mounting and dismounting is difficult and tedious.

It is therefore an object of the present invention to provide a snow blade mount and lift assembly for a vehicle that is easily attachable and removable from the vehicle.

It is a further object of the present invention to provide a hydraulically operated snow blade and lift assembly for a vehicle that is attached and removed from the vehicle using a self-aligning hitch mount devoid of conventional mounting pins.

It is yet a further object of the present invention to provide a snow blade hitch mount that includes a jack for lifting the assembly for proper vertical alignment with the vehicle chassis mount receiving plate.

SUMMARY OF THE INVENTION

The problems of the prior art have been overcome by the present invention, which provides a mount and lift assembly for hydraulically driven snow blades or other utilitarian accessories that includes a mount frame for mounting to the vehicle chassis and a one piece accessory assembly and lift frame readily removably coupled to the mount frame, the assembly in the case of a snow plow preferably including a blade trip frame and a snow blade removably coupled to the trip frame.

BRIEF DESCRIPTION OF THE DRAWINGS

FIG. 1A is a side view of a snow blade mounting system in accordance with the present invention;

FIG. 1B is an enlarged view of one embodiment of a mounting frame in accordance with the present invention;

FIG. 1C is an enlarged view of one embodiment of a latch in accordance with the present invention;

FIG. 6A is a side view of a snow blade mounting system in accordance with an alternative embodiment of the present invention;

FIG. 6B is an enlarged view of a latch in accordance with an alternative embodiment of the present invention;

FIG. 6C is an enlarged view of a mounting frame in accordance with an alternative embodiment of the present invention;

DETAILED DESCRIPTION OF THE INVENTION

Turning first to FIG. 1, there is shown generally at 10 the snow blade lift and hitch assembly in accordance with a preferred embodiment of the present invention. Vehicle mounting frame 11 attaches to the vehicle chassis frame behind the front bumper by suitable means such as pins or bolts (not shown). The actual design of the mounting frame 11 interface for attachment to the chassis will depend upon the identity (and thus design) of the particular chassis, and is well within the skill in the art.

The mounting frame 11 preferably remains permanently mounted to the vehicle chassis, regardless of whether the snow blade or other accessories are in use. It is fixed and has no moving parts; its main purpose being to provide a means of attachment of the follow-on components, such as those that provide the lift and angle of the snow blade where the follow-on component is a snow blade, and to absorb and transfer any shock loads imposed on the snow blade (or other accessory) into the vehicle chassis.

Figure 3B:
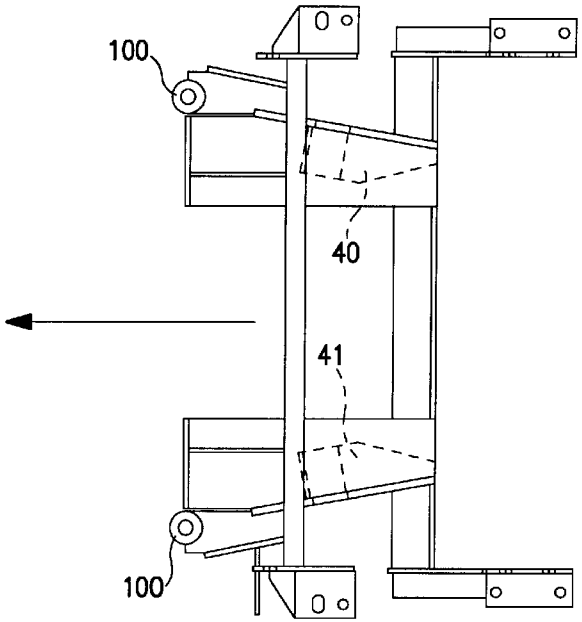
FIG. 3B is a top view of a mounting frame in accordance with the present invention.
Figure 3D:
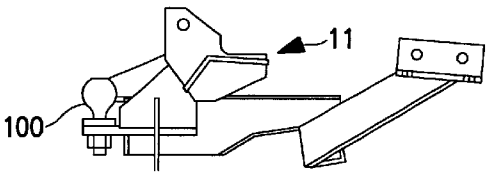
FIG. 3D is a side view of a mounting frame in accordance with the present invention.
Figure 3A:
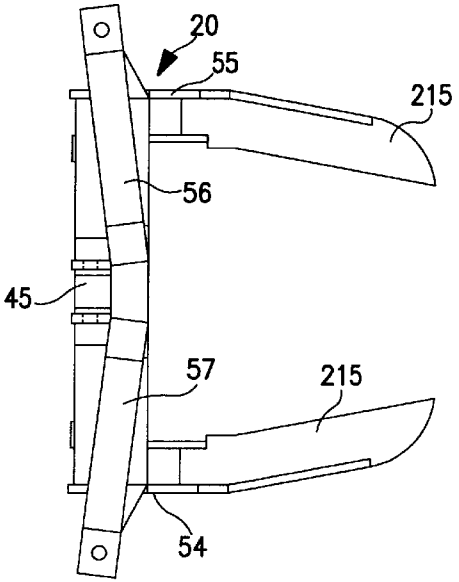
FIG. 3A is a top view of an accessory to be mounted to a vehicle in accordance with the present invention.

With particular reference to FIGS. 1, 3A and 3B, a receiver arrangement is created for the removable lift frame 20 and A-frame 30 integral therewith, or for any other accessory to be attached to the vehicle via the mounting frame 11. A pair of spaced side guides 40, 41 extend rearwardly in the direction towards the rear of the vehicle, and then inwardly toward each other as shown. The guides are preferably in a tapered profile such that the distance between them decreases in the direction towards the vehicle rear. The height of each side guide 40, 41 is also tapered such that it is progressively lower in the direction towards the vehicle rear. These angled side guides thus angle in and up, creating a trapezoidal wedge in both planes to provide a positive grip to the matching mounted hitch.

Tubular lift frame 20 and A-frame 30 assembly is adapted to be releasably coupled to the mounting frame 11. The following description of the lift frame 20 and A-frame 30 is similar to that disclosed in co-pending U.S. Ser. No. 08/640,145, the disclosure of which is incorporated herein by reference, although those skilled in the art will appreciate that the present invention is not limited to that particular lift frame and A-frame design. The lift frame 20 as shown has a generally rectangular shape, although the present invention is not to be so limited. A transverse vertical actuator support tube is coupled to the frame 20 between opposite side gusset plates 54, 55 (only one shown), and includes a central bracket 51 for attachment of one end of a vertical lifting means 52 such as a hydraulically driven actuator or cylinder. The opposite end of the vertical lifting means 52 is coupled to pivot hood 53, which in turn is pivotally mounted to the underside of top cross bar 45 of the frame 20 as shown. The pivot hood 53 has means to which one operative end of a linking means such as a chain 110 or the like can be mounted. The other operative end of the linking means is mounted by any suitable means to an angle iron coupled to the snow plow blade, so that actuation of the vertical lifting means 52 causes a corresponding vertical lift of the hood 53, which thereby lifts the snow plow blade.

Side gussets 54, 55 are shown coupled to vertical legs 46, 46' (only one shown) of the lift frame 20, such as by welding, and will be discussed in greater detail below. Triangular light mounts 56, 57 are provided on the frame 20 to support additional lighting or the like. Fixed to inside edges of the legs 46, 46' of the lift frame 20 are opposite right angle A-frame limit stops positioned to prevent the A-frame 30 from lifting too high.

A compartment in the A-frame 30 is defined by a top plate and an opposite, substantially co-extensive and spaced parallel bottom plate. A ring block 36 comprising a tubular base section and a top plate and is mounted on the top surface of the A-frame and mates to a stabilizer ½ ring 77 attached to the trip frame 70. The block 36 contains and stabilizes the ½ ring 77, thus stabilizing the trip frame to which the ½ ring 77 is attached. Those skilled in the art will appreciate that the ring block 36 can be designed having shapes other shapes than that shown, as long as the ring properly stabilizes the trip frame assembly 70.

Located in the body of the A-frame substantially between the top and bottom surfaces is an actuator drive cavity. Locating the actuator drive means (preferably an electric/hydraulic pump assembly) substantially within the body of the A-frame 30 lightens the lift frame 20 (where the pump was conventionally located) for easy removal. Instead, the dead weight of the actuator drive means is advantageously added to the blade, assisting in creating a cleaner snowplow pass. Importantly, the actuator drive means in this location in no way obstructs the radiator of the vehicle, thereby allowing proper air flow to cool the vehicle engine and help prevent overheating. In addition, the actuator drive means is well sheltered, minimizing potential damage as the vehicle approaches the blade assembly for mounting. It also allows for shorter hydraulic lines to the angle pistons, and allows for more clearance in the basic geometry, thereby allowing higher blade motion for stacking snow. Preferably, the bulk of the actuator drive means is located substantially in the horizontal plane of the A-frame defined by the top and bottom surfaces. Most preferably, a lower recess/skid plate coupled to the underside of the A-frame bottom plate supports the pump assembly slightly below the plane of the bottom plate of the A-frame 30, thereby maximizing the lift height of the A-frame 30. A removable top cover optionally having a hydraulic fluid reservoir fill cap provides further protection for the pump assembly.

Trip frame assembly 70 is the preferred means for attaching the snow blade to the A-frame 30. The trip frame 70 allows the blade to pivot forward, which allows it to trip over obstacles and absorb shock that would otherwise be transferred into the plow frame assembly and vehicle, which in extreme cases would cause substantial damage. The front of the trip frame 70 is defined by a trip frame angle pivot, which comprises a top horizontal plate and a spaced, parallel, co-extensive bottom horizontal plate. Angled plates receive the apex of the A-frame and provide a stop. The A-frame is pivotally mounted through an axially aligned hole in the horizontal plates. The trip frame angle pivot includes four horizontal axially aligned pivot bushings each mounted on a rib intersecting the horizontal top and bottom plates. The pivot bushings each mate to a recess formed in the back of the plow blade. Welded at extreme opposite ends of trip frame 70 are right angle blade trip stops. These provide an angled stop against the vertical blade rib of blade. Were the blade allowed to trip forward all the way to the ground, it could become lodged or could spring board up very abruptly, causing damage. In addition, the lower stop keeps the spring extension within its designed operating range which prevents the springs from stretching (overstretching of the springs permanently damages the springs, making them unable to return the blade to its full upright position).

Those skilled in the art will recognize that the foregoing trip frame assembly is not required; the snow blade can articulate directly from the A-frame and by directly coupled thereto via pistons and pivots. Other trip frame designs could also be used.

Welded on the top cross bar of the trip frame 70 is the ½ ring 77 mentioned above, which stabilizes the trip assembly and pivot. A right angle cross bar is positioned within the ½ ring 77, and supports a plurality of trip return springs means (not shown). The opposite ends of the return springs means are coupled to the snow blade through an upper spring mount on the rear of the blade.

A pair of spaced horizontal actuators such as cylinders are each mounted at one end between the top and bottom horizontal plates of the trip frame. The opposite ends of each horizontal actuator are pivotally coupled to the A-frame. These horizontal actuators are operatively connected to the actuator drive assembly (not shown) housed in the A-frame 30 cavity by suitable hosing.

The snow blade can be conventional in design. The preferred blade is a sheet of steel bumped or rolled to a semi-round shape and then braced on the backside with a plurality of vertical ribs and horizontal members comprised of formed stiffeners and a frog angle at the very base to absorb shock. C-shaped shoe mounts coupled to the back of the plow blade provide a surface for the blade to ride on.

The controls for operating the assembly are housed inside the cab of the vehicle for easy access to the operator. Typically, there are two separate momentary contact switches in any position but the down position, where it is not momentary. A plurality of solenoids are used to control the mechanism, such as a solenoid to control the power that runs the motor for the pump. This circuit is energized off of any of the control positions except the down position, thereby actuating the pump to raise and/or angle the blade. Gravity allows the blade to return to ground. Three hydraulic solenoids are mounted to the output manifold of the pump. One is the unit that opens the path to lift the blade, another is the unit that opens the path to lower the blade assembly. In the up position, the first solenoid opens the valve and the pump is energized, which raises the blade. In the down position, the other solenoid opens its respective valve, but the pump is not energized, which allows the blade to lower.

There is a three-position hydraulic spool valve for the angling of the blade. As the switch is pushed to one side, it opens the corresponding valve and energizes the pump, which then pumps fluid into the corresponding piston which causes the piston to extend and to thereby angle the blade. At the same time, it allows the non-pressurized piston to collapse and fluid to return to the tank (the force of the extending piston collapses the opposite piston). When the switch is engaged in the other direction, the reverse occurs. When the switch is returned to the neutral position, so does the valve. The foregoing is illustrative of the control mechanism, but those skilled in the art will appreciate that other methods of controlling accessory actuation can be used without departing from the spirit and scope of the present invention.

Further details will now be provided regarding the hitch mount of the present invention. As discussed above, mounting frame 11, preferably made of ⅜" mild steel, is coupled to the vehicle chassis by suitable means. The front plow engaging end of the mounting frame 11 includes a one or more vertical studs 100 having a free end that is preferably chamfered. In the preferred embodiment, there are two such studs 100 spaced apart an optimal distance for supporting the accessory to be attached. Also in the preferred embodiment shown, the free ends of the studs 100 are spherical, and the head of each stud 100 terminates in a flattened portion 101.

The studs 100 can be fixed to the mounting frame 11 by any suitable means, such as welding or bolting. Preferably the cross-section of the stud(s) 100 is large enough to support the entire weight of the implement being attached when it is lifted off the ground, and is large enough to resist the directional forces applied to the stud(s) 100 when the implement is being worked. The chamfer on the free end of the stud(s) 100 should extend approximately one-half of the diameter of the stud from the free end in order to facilitate engagement with the accessory being attached. The top portion 101 of the free end of the stud(s) 100 is preferably flat (FIG. 1B).

Figure 3C:
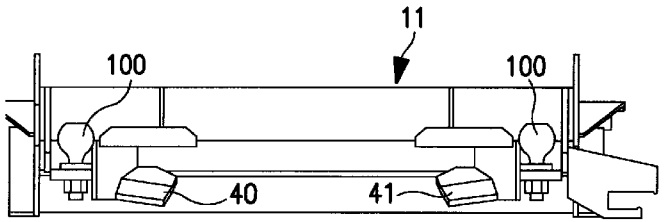
FIG. 3C is a front view of a mounting frame in accordance with the present invention.

Mounting frame 11 includes generally longitudinally extending (in the direction from the vehicle front to the vehicle rear) guide members 40, 41 as discussed above, which help ensure proper alignment of the lift assembly 20 or other accessory being attached. The spacing or volume between these guide members and the top of mounting frame 11 (FIG. 3B) is configured to accommodate the male ends 215 of the hitch assembly coupled to the lift frame 20 via the side gussets 54, 55 (FIG. 3A). Thus the male ends 215 are preferably fork-like, with rounded corners to facilitate hitch engagement. The male ends 215 preferably taper towards each other toward their free ends as shown in FIG. 3A. A corresponding taper is present in the mounting frame 11 in the space between guides 40, 41 (best shown in FIG. 3C); guide members 40, 41 are configured and placed such that the receiver volume is tapered, with its end farthest from the vehicle front being shorter than the end closest the studs 100. The guide members 40, 41 thus act as a track for receiving and aligning male ends 215. Each guide member 40, 41 is preferably tilted downward (in the direction towards the longitudinal centerline of the frame 11) as shown in FIG. 3C.

Pivotally coupled to each side gusset 54, 55 via pivot shaft 219 are respective latches 220. Preferably the latches 220 share a common pivot shaft, the pivot shaft extending from one latch to the other so that movement of the two latches is coordinated; actuation of one latch results in a corresponding movement of the other latch. In this way, the movement of the latches can be controlled by a single lever 221 coupled to one of the latches 220. Alternatively, separate pivot pins could be used for each latch 220, with each latch having separate means for actuation.

Figure 2A:
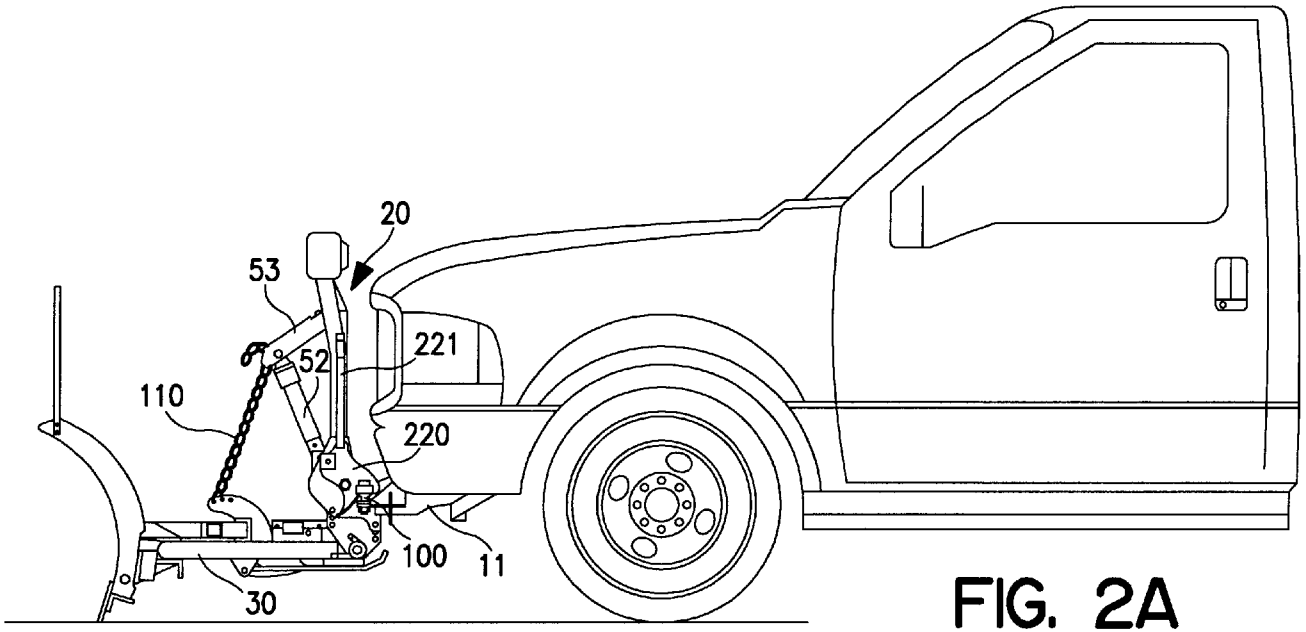
FIG. 2A is a side view of the snow blade mounting system of FIG. 1A shown in the latched position.
Figure 2B:
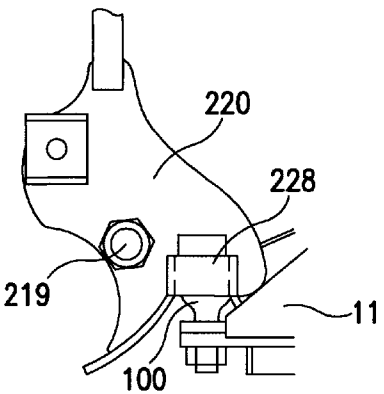
FIG. 2B is an enlarged view of the latch of FIG. 1C shown in the latched position.

Each latch 200 is shaped to receive and lock onto the free end of stud 100 as shown in FIGS. 2A and 2B. More specifically, with reference to FIG. 1C, the recess in the latch 220 includes a first angled flange 223 extending from the latch 220, and a second angled flange 224 spaced from the first and also extending from the latch 220. Preferably the second angled flange 224 is longer than the first flange 223, and provides a camming surface which is engaged by the chamfered surface of the stud 100 as contact therebetween is made. This contact causes the latch 220 to pivot about axis 219 towards the vehicle, causing the stud to enter the recess 225, align properly in that recess, and causing the angled flange 223 to be positioned behind the stud 100 (i.e., between the stud 100 and the vehicle), thereby locking the stud 100 into the recess 225. The angled flange 223 is preferably also a camming surface to assist in the engagement and alignment of the stud 100 in the recess 225.

The latch 220 also includes within recess 225 a solid cap 228 which is configured to match the shape of the free end of the stud 100. The cross-sectional area of the recess 225 and cap 228 should be large enough to support the entire weight of the implement when it is lifted, as well as resist the directional forces applied to it when the implement is being worked. The free end of the stud 100 is shown engaged in the solid cap 228 in FIG. 2B, and the flattened head 101 of stud 100 helps ensure a good fit.

Figure 4B:
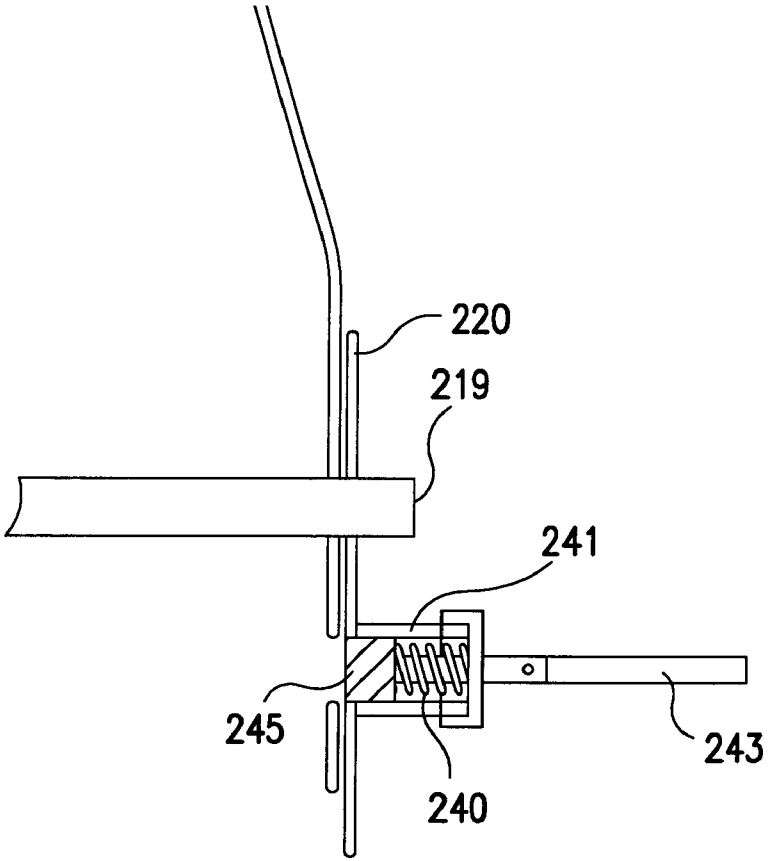
FIG. 4B is a cross-sectional view of the locking pin shown in the unlocked position in accordance with the present invention.
Figure 4A:
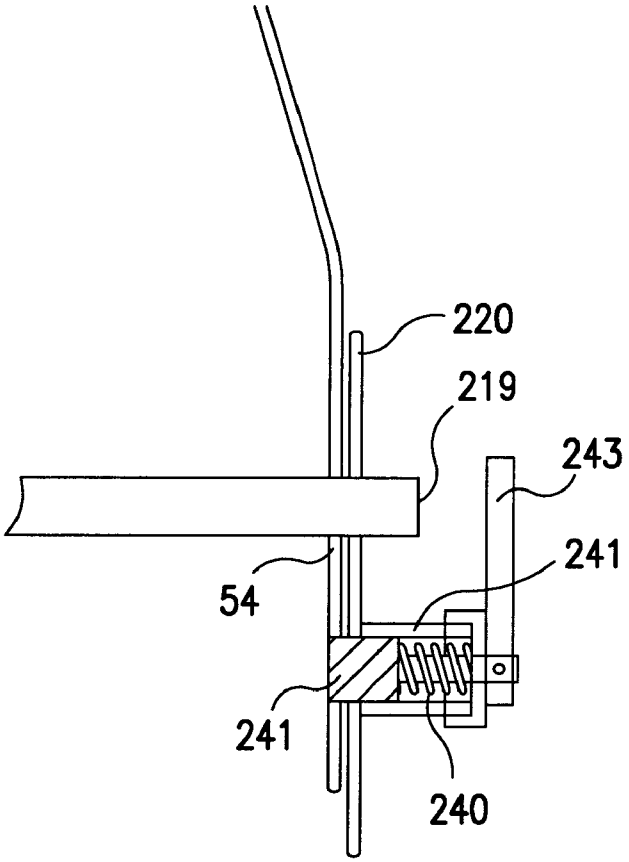
FIG. 4A is a cross-sectional view of the locking pin shown in the locked position in accordance with the present invention.

A latch locking assembly means 230 is used to lock the apparatus in place. One suitable locking assembly, best seen in FIGS. 4A and 4B, includes a spring loaded pin assembly 230, with spring 240 biasing against pin 241. In the locked position of FIG. 4A, spring 240 forces pin 241 through an appropriately dimensioned aperture 245 (FIG. 4B) in side gusset 54, thereby fixing the latch 220 in place. Lever 243, shown in FIG. 4A in the locked (orthagonal) position, prevents pin 241 from retracting out of the aperture in the gusset 54. In the unlocked position of FIG. 4B, the pin is retracted from the aperture, allowing movement of the latch for engagement or disengagement of the hitch. Each latch 200 can have a safety lock, or preferably a single safety lock can be used, preferably in conjunction with the latch that is located on the same side of the apparatus as lever 221, for operator convenience.

Figure 5:
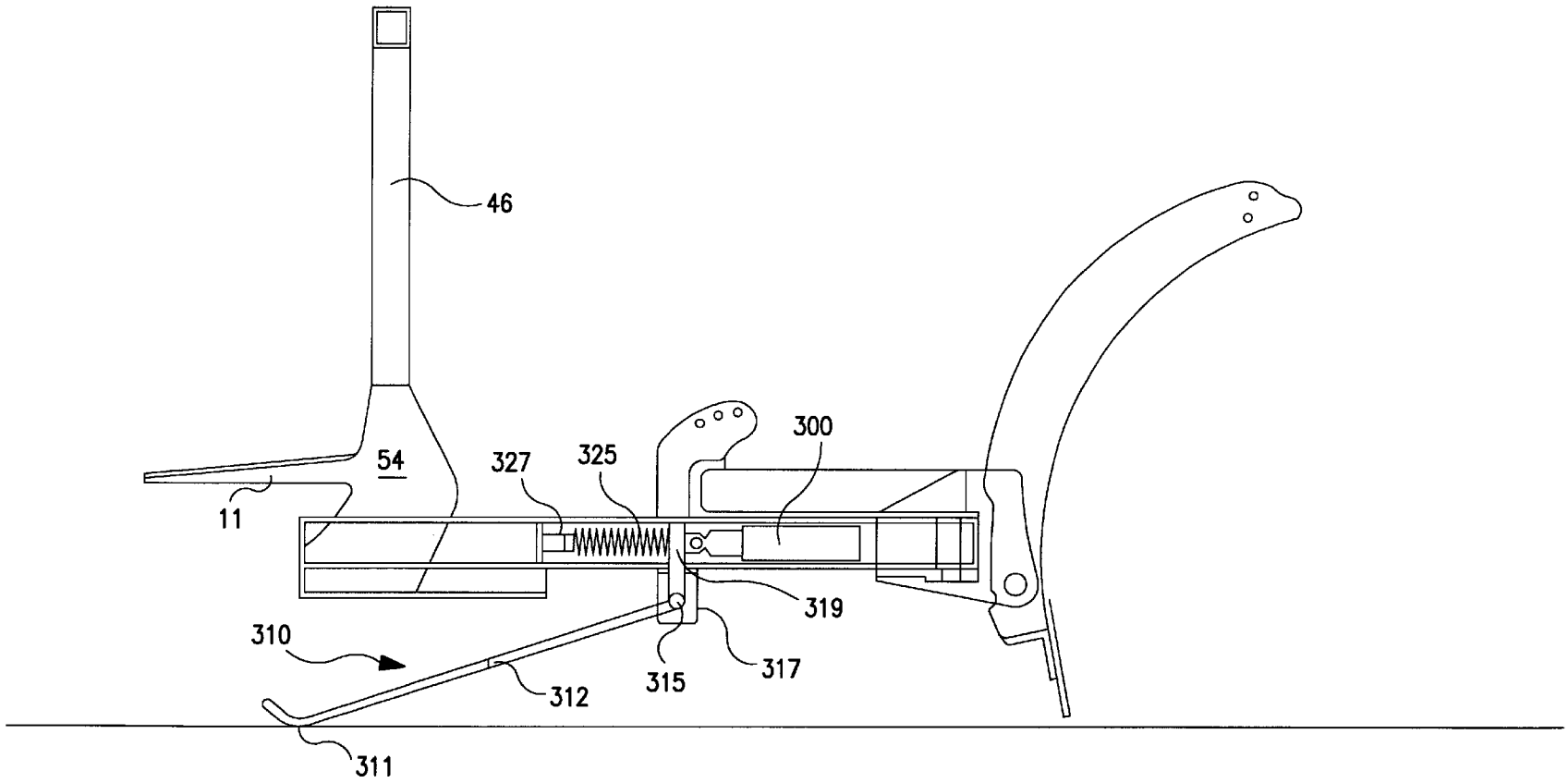
FIG. 5 is a cross-sectional view of the jack assembly in accordance with the present invention.

Turning now to FIGS. 1A and 2A, the jack assembly of the present invention is shown. The jack is preferably power operated such as by a hydraulic cylinder positioned in the cavity of the A-frame 30. The cylinder 300 is located in the body of the A-frame substantially between the top and bottom surfaces in the actuator drive cavity, forward (away from the vehicle) of where the snow blade hydraulic assembly is located. Locating this jack drive means substantially within the body of the A-frame 30 lightens the lift frame 20 (where the pump was conventionally located) for easy removal. Instead, the dead weight of the jack drive means is advantageously added to the blade, assisting in creating a cleaner snowplow pass. Importantly, the jack drive means in this location in no way obstructs the radiator of the vehicle, thereby allowing proper air flow to cool the vehicle engine and help prevent overheating. In addition, the jack drive means is well sheltered, minimizing potential damage as the vehicle approaches the blade assembly for mounting. Preferably, the bulk of the jack drive means is located substantially in the horizontal plane of the A-frame defined by the top and bottom surfaces. As shown in FIG. 5, jack foot 310, which preferably includes a curved skid shoe portion 311 and a relatively straight elongated portion 312 is coupled to tab 319, such as by welding, at about a 45° angle. This assembly is pivotally coupled to the A-frame assembly via pin 315 through opposite side gussets 317 (one shown) The jack shoe 311 is lowered by actuation of the hydraulic cylinder 300, which causes counter-clockwise rotational movement of the tab 319 about the axis of the pin 315. A return spring 325 biases against the cylinder 300 such that the jack 310 can be raised by retraction of the cylinder 300, this time by clockwise rotational movement of the tab 319 about the axis of the pin 315. An adjusting nut 327 is used to provide the proper tension on spring 325. By lowering the jack 310, the assembly can be raised to the appropriate height for engagement with the female receiving end of the hitch assembly mounted on the vehicle. This design allows for raising or lowering of the jack to virtually any extent within its raised (i.e., stowed in a position substantially parallel to the A-frame) and lowered (i.e., as shown in FIG. 5) range, in contrast to the prior art which allowed for only incremental lowering or raising (such as in half inch or one inch increments). This greatly facilitates the mounting operation, especially where the height of the lift assembly has changed, such as due to snow accumulation on the ground. Preferably the hydraulic controls are placed in an accessible location, such as the front of the vehicle grill, so that the operator can operate the jack while visually inspecting the height of the lift assembly and align it appropriately with the vehicle. Preferably the hydraulic controls include a flow divider which routes the hydraulic fluid to either the actuator drive or to the jack drive, as needed.

In a preferred embodiment, the jack activation switch includes two built-in safety features. When the jack is to be used, it is controlled by a switch on the A-frame (or the vehicle grill). However, the switch will not activate the jack unless the in-cab controls are locked in the float (i.e., lower) position, as only in this position is power supplied to the jack switch. As a result, it is not possible to operate the jack while the snow plow is in the raised position, as this could be potentially hazardous to the user. In addition, once the plow is locked securely on the vehicle, if the jack is not retracted, there is a wired-in safety to ensure that the jack arm is retracted prior to activating the plow blade. Specifically, the in-cab plow blade lift control is wired to the jack retract circuit. As a result, if the jack is not retracted, when the operator used the in-cab lift function, the jack will automatically retract, making it impossible to operate the snow plow blade with the jack in the extended position.

Figure 7A:
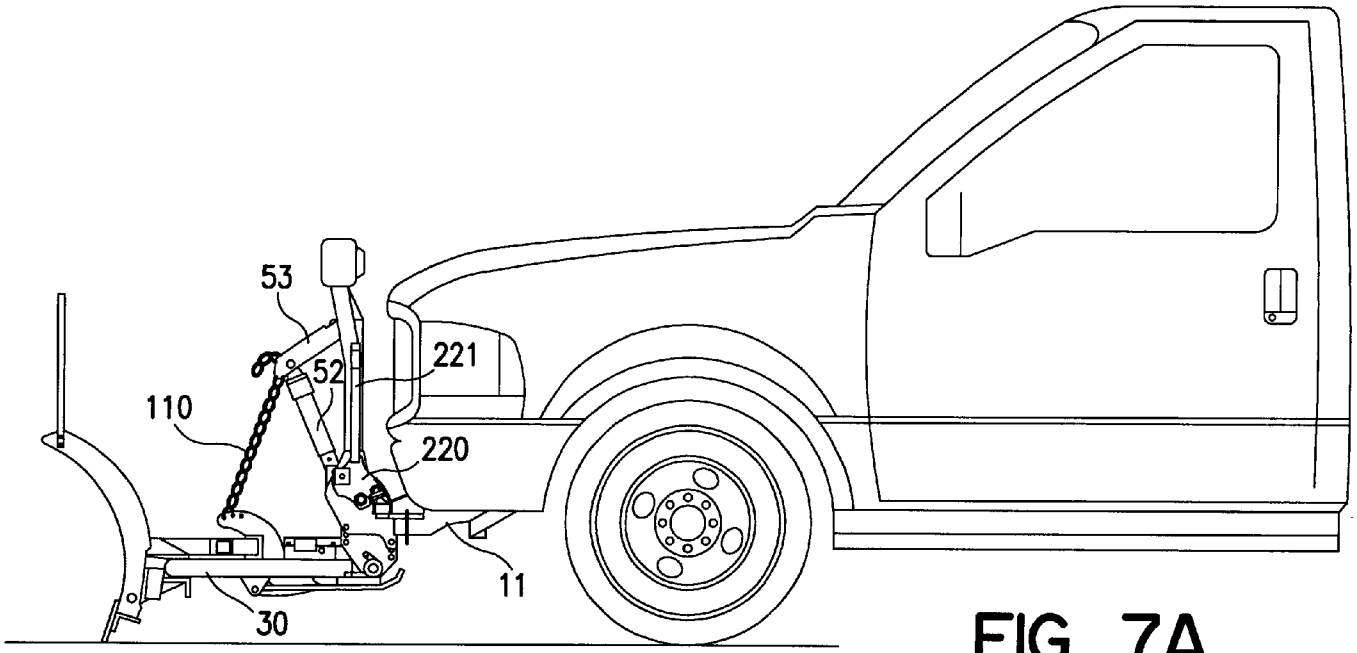
FIG. 7A is a side view of the snow blade mounting system of FIG. 6A shown in the latched position.
Figure 7B:
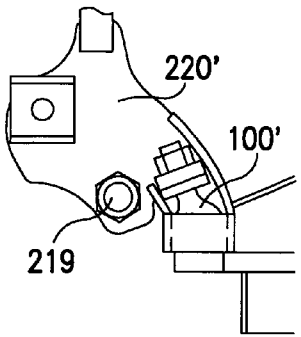
FIG. 7B is an enlarged view of the latch of FIG. 6B shown in the latched position.

Those skilled in the art will appreciate that the location of the studs 100 and the latches 220 can be reversed; the studs 100 can be located on the accessory being attached, and the latches on the vehicle chassis, as shown in FIGS. 6A, 6B, 6C, &A and 7B. Thus, in FIG. 6B, stud 100' is mounted on pivotable latch 220' such as by welding. The latch 220' is the same as the latch 220 discussed above except for the substitution of the stud 100' for the recess 225 and corresponding cap 228 and flanges 223 and 224. The cap 228' and flanges 223' and 224' are instead located attached to mounting frame 11', which is affixed to the vehicle chassis and is stationary. As the stud 100' approaches the mounting frame 11', the camming surface on the flange 224' contacts the chamfered surface of the studs 100' and causes the latch 220' to pivot, whereby the stud 100' is received by cap 228' as illustrated in FIGS. 7A and 7B.

In operation, the vehicle is positioned close to the hitch assembly, and the jack mechanism is operated so that the lift assembly is raised or lowered depending upon the height of the mounting frame 11. Once the proper height is achieved (as determined by visual inspection), the vehicle is driven towards the male end 215 of the hitch assembly so that it is received under the mounting frame 11. At this point the latches 220 are in the unlocked position shown in FIG. 1A, positioned to grasp and engage the studs 100. Once the studs 100 are positioned in the recesses 225 of the latches 220, the lever 221 can be used to ensure that the latches 220 have been fully actuated to the locked position as shown in FIGS. 2A and 2B. Suitable locking pins or other safety locking mechanism can be used to ensure that the lift assembly does not prematurely disengage from the vehicle. The lift assembly is now locked to the vehicle chassis. The jack is then lifted back substantially parallel with the A-frame where it is stowed during use of the plow. To disengage the lift assembly from the chassis, the jack is lowered to the ground to support the assembly, and the lever 221 is placed in the down position, which pushes the latch away from the studs 100, disengaging the same and actually pushing the mounting frame 11 away from the lift assembly.

This configuration greatly facilitates the mounting procedure and reduces the risk of injury, as the operator is inside the vehicle during the mounting process. In the event the lift frame 20 was not properly aligned with the mounting frame 11 during the procedure and the latches 220 do not completely lock automatically, the operator can complete the locking process by proper manual clockwise rotation of the handle 221 of the latch.

Those skilled in the art will appreciate that although the lift frame of the alternative embodiment can be automatically mounted to the vehicle as detailed above, the present invention also includes within its scope the case where the lift frame of the alternative embodiment is manually mounted by proper manual actuation of the latch handle 221.

What is claimed is:

1. A mounting hitch assembly for a vehicle having a chassis, comprising:

a hitch mounting frame adapted to be fixed to said vehicle chassis, said hitch mounting frame comprising at least one chamfered stud;

an accessory to be mounted to said hitch mounting frame, said accessory comprising at least one latch for engaging said at least one chamfered stud, said latch comprising a camming surface configured to pivot said latch upon contact with said chamfered stud.

2. The mounting hitch of claim 1, wherein said chamfered stud comprises a spherical portion having a flattened head, and wherein said latch comprises a recess having a cap for receiving said flattened head.

3. The mounting hitch of claim 1 or 2, wherein said accessory comprises a lift frame assembly comprising an A-frame having a first end and a second end spaced from said first end, and wherein said A-frame second end comprises a pivot, and further comprising snow blade mounting means comprising a trip frame pivotally mounted to said second end pivot for mounting a snow blade.

4. The mounting hitch of claim 3, wherein between said first end and said second end of said A-frame is a cavity, said hitch further comprising actuator drive means mounted in said cavity for lifting said snow blade.

5. The mounting hitch of claim 4, wherein said lift assembly comprises at least one actuator driven by said actuator drive means for lifting said snow blade.

6. The mounting hitch of claim 4, further comprising a power operated jack pivotally coupled to said accessory for raising or lowering said lift frame assembly relative to said vehicle chassis.

7. The mounting hitch of claim 6, wherein said jack comprises a shoe, an elongated portion and a tab attached to said elongated portion, whereby rotational movement of said tab causes raising or lowering of said shoe with respect to said chassis.

8. The mounting hitch of claim 6, wherein power means to operate said jack assembly is housed in said cavity.

9. The mounting hitch of claim 1, wherein said mounting frame further comprises a pair of spaced guides.

10. A mounting hitch assembly for a vehicle having a chassis, comprising:

an accessory to be mounted to said hitch mounting frame, said accessory comprising at least one chamfered stud;

a hitch mounting frame adapted to be fixed to said vehicle chassis, said hitch mounting frame comprising at least one latch for engaging said at least one chamfered stud, said latch comprising a camming surface configured to pivot said latch upon contact with said chamfered stud.

11. The mounting hitch of claim 10, wherein said chamfered stud comprises a spherical portion having a flattened head, and wherein said latch comprises a recess having a cap for receiving said flattened head.

12. The mounting hitch of claim 10 or 11, wherein said accessory comprises a lift frame assembly comprising an A-frame having a first end and a second end spaced from said first end, and wherein said A-frame second end comprises a pivot, and further comprising snow blade mounting means comprising a trip frame pivotally mounted to said second end pivot for mounting a snow blade.

13. The mounting hitch of claim 12, wherein between said first end and said second end of said A-frame is a cavity, said hitch further comprising actuator drive means mounted in said cavity for lifting said snow blade.

14. The mounting hitch of claim 13, wherein said lift frame assembly comprises at least one actuator driven by said actuator drive means for lifting said snow blade.

15. The mounting hitch of claim 13, further comprising a power operated jack pivotally coupled to said accessory for raising or lowering said accessory relative to said vehicle chassis.

16. The mounting hitch of claim 15, wherein said jack comprises a shoe, an elongated portion and a tab attached to said elongated portion, whereby rotational movement of said tab causes raising or lowering of said shoe with respect to said chassis.

17. The mounting hitch of claim 15, wherein power means to operate said jack assembly is housed in said cavity.

18. The mounting hitch of claim 10, wherein said mounting frame further comprises a pair of spaced guides.

19. A method of mounting a lift assembly to a vehicle chassis, comprising:

providing a hitch mounting frame adapted to be fixed to said vehicle chassis, said hitch mounting frame comprising at least one chamfered stud;

providing an accessory to be mounted to said hitch mounting frame, said accessory comprising at least one latch for engaging said at least one chamfered stud, said latch comprising a camming surface configured to pivot said latch upon contact with said chamfered stud;

aligning said accessory so that said at least one latch is disposed to receive said at least one stud; and driving said vehicle chassis towards said accessory, causing said at least one latch to engage said at least one stud and attach said accessory to said mounting frame.

20. The method of claim 19, wherein said step of aligning comprises vertical alignment of said accessory with respect to said vehicle chassis by providing a jack comprising a shoe, an elongated portion attached to said shoe, and a tab attached to said elongated portion, said jack being pivotally coupled to said accessory between said elongated portion and said tab via a pivot axis; and causing said tab to move rotationally about said pivot axis, said rotational movement of said tab causing a corresponding lowering or raising of said shoe with respect to said vehicle chassis.

* * * * *